US011030954B2

(12) United States Patent
Choi et al.

(10) Patent No.: US 11,030,954 B2
(45) Date of Patent: Jun. 8, 2021

(54) PIXEL SENSING DEVICE, ORGANIC LIGHT EMITTING DISPLAY DEVICE INCLUDING THE SAME AND METHOD THEREOF

(71) Applicant: LG Display Co., Ltd., Seoul (KR)

(72) Inventors: Sungwook Choi, Paju-si (KR); Yiyeon Hwang, Paju-si (KR); Munchae Yoon, Paju-si (KR); Jongsin Park, Paju-si (KR); Sungwon Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/689,014

(22) Filed: Nov. 19, 2019

(65) Prior Publication Data

US 2020/0175921 A1 Jun. 4, 2020

(30) Foreign Application Priority Data

Dec. 4, 2018 (KR) ..... 10-2018-0154368

(51) Int. Cl.
*G09G 3/3241* (2016.01)
*G09G 3/3258* (2016.01)

(52) U.S. Cl.
CPC ..... *G09G 3/3241* (2013.01); *G09G 3/3258* (2013.01); *G09G 2300/0828* (2013.01)

(58) Field of Classification Search
CPC ..... G09G 3/3241; G09G 3/3258; G09G 2300/0828
See application file for complete search history.

(56) References Cited

U.S. PATENT DOCUMENTS

2003/0164812 A1* 9/2003 Lee ..... H03M 1/0607 345/98
2004/0263463 A1* 12/2004 Yoo ..... G09G 3/3688 345/98
2008/0036708 A1* 2/2008 Shirasaki ..... G09G 3/3291 345/76
2015/0379909 A1 12/2015 Yu et al.
2016/0163265 A1 6/2016 Yang et al.
2018/0033372 A1* 2/2018 Kishi ..... G09G 3/3233
2018/0151124 A1* 5/2018 An ..... G09G 3/3291

OTHER PUBLICATIONS

The Intellectual Property Office of the United Kingdom, Search Report, GB Patent Application No. 1916852.5, dated May 12, 2020, four pages.

* cited by examiner

*Primary Examiner* — Stephen G Sherman
(74) *Attorney, Agent, or Firm* — Fenwick & West LLP

(57) ABSTRACT

Embodiments are directed to a display device having a display panel, a driving circuit, a sensing circuit, and a compensation circuit. The driving circuit provides a preset sensing voltage to a pixel of the display panel. The sensing circuit senses a pixel current generated by the pixel. The sensing circuit includes a sensing circuit that generates an integrated voltage signal indicative of the pixel current, and an offset circuit for adding an offset to the integrated voltage signal. The offset is based on a previously stored compensation amount for the pixel. The compensation circuit determines a new compensation amount for the pixel based on the offset integrated voltage. Additionally, the compensation circuit compensates a display voltage of the pixel by the new compensation amount in a subsequent display frame of the display device.

19 Claims, 10 Drawing Sheets

PIXEL SENSING DEVICE, ORGANIC LIGHT EMITTING DISPLAY DEVICE INCLUDING THE SAME AND METHOD THEREOF

CROSS REFERENCE TO RELATED APPLICATIONS

This application claims the is based on and claims priority to Korea Patent Application No. 10-2018-0154368 filed on Dec. 4, 2018, which are incorporated herein by reference for all purposes as if fully set forth herein.

BACKGROUND

Field of Technology

The present disclosure relates to an organic light emitting display device.

Discussion of the Related Art

An organic light emitting display device of an active matrix type arranges the pixels each including an organic light emitting diode OLED, a driving Thin Film Transistor TFT in a matrix form and controls the luminance of the image represented in the pixels according to the grayscale of image data. The driving TFT controls the pixel current flowing through the OLED according to the voltage applied between a gate electrode and a source electrode of the driving TFT (hereinafter, it is called as gate-source voltage). The amount of light emitted by the OLED and the luminance of a screen are determined according to the pixel current.

Since the threshold voltage and electron mobility of the driving TFT, the operating point voltage of the OLED and the like determine the driving characteristics of a pixel, the characteristics of all pixels must be same. However, due to various causes such as process properties, time varying properties and the like, the driving characteristics become different among the pixels. Such a difference in driving characteristic causes a luminance deviation, which is a limitation in displaying image as desired quality. As a method of compensating for the luminance deviation between pixels, the external compensating scheme is known which senses the driving characteristics of pixels and adjusts input image data based on the sensing results.

SUMMARY

Among the external compensating scheme, there is a method of using a sensing means and an analog to digital converter ADC in order to sense the driving characteristics of pixels. The ADC converts the sensing output voltage output from the sensing means into a digital signal.

The input voltage range of the ADC, that is a sensing range or an input voltage range is predetermined. So, when the sensing output voltage input to the ADC is out of the sensing range, the output value of the ADC may be underflowed below the lower limit value of the input voltage range or overflowed above the upper limit value of the input voltage range. As such, if the output of the ADC is distorted, the accuracy of sensing and compensating is degraded.

Accordingly, an objective of the present disclosure is to provide a pixel sensing device, the organic light emitting display device including the pixel sensing device and a sensing output controlling method which regulates the sensing output voltage so as not to deviate from the sensing range of the ADC.

Embodiments are directed to a display device having a display panel, a driving circuit, a sensing circuit, and a compensation circuit. The driving circuit provides a preset sensing voltage to a pixel of the display panel. The sensing circuit senses a pixel current generated by the pixel. The sensing circuit includes a sensing circuit that generates an integrated voltage signal indicative of the pixel current, and an offset circuit for adding an offset to the integrated voltage signal. The offset is based on a previously stored compensation amount for the pixel. The compensation circuit determines a new compensation amount for the pixel based on the offset integrated voltage. Additionally, the compensation circuit compensates a display voltage of the pixel by the new compensation amount in a subsequent display frame of the display device.

In some embodiments, the offset circuit includes a coupling capacitor, an initial voltage supplier, and an initialization switch. The coupling capacitor has a first terminal coupled to an output of the sensing circuit. The initial voltage supplier supplies the offset. The initialization switch connects the initial voltage supplier to a second terminal of the coupling capacitor for storing the offset in the coupling capacitor.

In some embodiments, the sensing circuit includes a current integrator. The current integrator includes an amplifier, a feedback capacitor, and a reset switch. The amplifier has a first input terminal receiving a reference voltage, a second input terminal coupled to the pixel for receiving the pixel current, and an output terminal for outputting the integrated voltage signal. The feedback capacitor is coupled between the second input terminal of the amplifier and the output terminal of the amplifier. The reset switch is coupled between the second input terminal of the amplifier and the output terminal of the amplifier. The reset switch is closed to initialize the output terminal of the amplifier to be the reference voltage.

In some embodiments, the initialization switch operates in synchronization with the reset switch of the current integrator.

In some embodiment, the integrated voltage signal of the current integrator changes from the reference voltage responsive to the reset switch turning off, and the offset integrated voltage changes from the offset responsive to the initialization switch turning off.

In some embodiments, a voltage difference between the reference voltage and the integrated voltage signal is equal to a voltage difference between the offset and the offset integrated voltage.

In some embodiments, the offset circuit includes a bypass switch coupled between the first and second terminal of the coupling capacitor. The bypass switch bypasses the offset circuit when the offset switch is closed.

In some embodiments, the sensing circuit includes an analog-to-digital converter (ADC). The ADC is coupled to the second terminal of the coupling capacitor. The ADC has a sensing range. The offset is further based on the sensitivity range of the ADC. The sensitivity range of the ADC is centered on a center value of a sensing range of the analog-to-digital converter.

In addition, some embodiments are directed to a method for compensating a display voltage of a pixel. A preset sensing voltage is provided to a pixel of a display panel. An integrated voltage signal indicative of a magnitude of the pixel current is generated. An offset is added to the integrated voltage signal. The offset is based on a previously stored compensation amount for the pixel. A new compensation amount for the pixel is determined based on the offset integrated voltage, and a display voltage of the pixel is compensated by the new compensation amount in subsequent display frames of the display device.

In some embodiments, the integrated voltage signal is generated by resetting the integrated voltage signal to have a value of a reference voltage, and modifying the integrated voltage signal based on an integration of pixel current.

In some embodiments, the integrated voltage signal is modified by decreasing a value of the integrated voltage signal with a rate according to the pixel current.

In some embodiments, the offset is added to the integrated voltage signal by determining the offset based on the previously stored compensation amount for the pixel, and storing the offset in a coupling capacitor configured to receive the integrated voltage signal.

In some embodiments, the offset is further based on a sensitivity range of an analog-to-digital converter.

In some embodiments, the offset is added to the integrated voltage signal by decreasing a voltage level of the integrated voltage signal responsive to a previous offset integrated voltage having a value above a sensitivity range of the analog-to-digital converter.

In addition, some embodiments of the method include sampling the integrated voltage using the analog-to-digital converter, and determining the new compensation amount based on the sampled offset integrated voltage and the offset added to the integrated voltage signal.

Moreover, some embodiments are directed to another method for compensating a display voltage of a pixel. A current integrator is reset to have an output voltage substantially equal to a reference voltage and integrates the pixel current received from a pixel of the display device. An offset integrated voltage is generated by adding an offset to the output of the current integrator. The integrated voltage is sampled using an analog-to-digital converter. A compensation amount is determined for the pixel based on the sampled offset integrated voltage and the offset, and a display voltage of the pixel is compensated by the compensation amount in a subsequent display frame of the display device.

In some embodiments, the integrated voltage signal is modified based on an integration of the pixel current. In one embodiment, the integrated voltage signal is modified by decreasing the output voltage of the current integrator with a rate according to the pixel current.

In some embodiments, the offset is added to the output of the voltage of the current integrator by determining the offset based on a previous output of the analog-to-digital converter, and storing the offset in a coupling capacitor configured to receive the output voltage of the current integrator.

In some embodiments, the offset is further based on a sensitivity range of the analog-to-digital converter. The sensitivity range of the analog-to-digital converter is centered on a center value of a sensing range of the analog-to-digital converter.

BRIEF DESCRIPTION OF THE DRAWINGS

The accompanying drawings, which are included to provide a further understanding of the present disclosure and are incorporated in and constitute a part of this specification, illustrate embodiments of the present disclosure and together with the description serve to explain the principles of the present disclosure. In the drawings.

DETAILED DESCRIPTION

Figure 1:
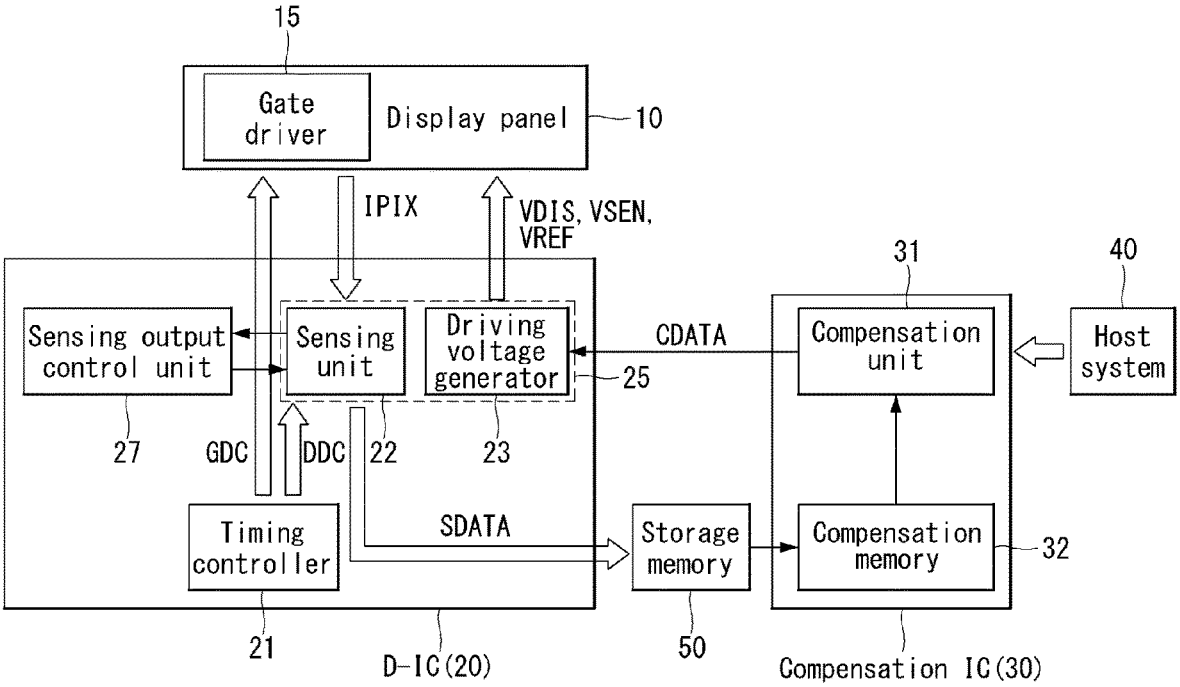
FIG. 1 shows a block diagram illustrating an organic light emitting display device according to an embodiment of the present disclosure.

The advantages and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, percentages, angles, numbers, etc. shown in the figures to describe the exemplary embodiments of the present disclosure are merely examples and not limited to those shown in the figures. Like reference numerals denote like elements throughout the specification. When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element. Thus, a first element referred to below may be a second element within the scope of the present disclosure.

In this specification, the pixel circuit and the gate driver formed on the substrate of a display panel may be implemented by a TFT of an n-type MOSFET structure, but the present disclosure is not limited thereto so the pixel circuit and the gate driver may be implemented by a TFT of a p-type MOSFET structure. The TFT or the transistor is the element of 3 electrodes including a gate, a source and a drain. The source is an electrode for supplying a carrier to the transistor. Within the TFT the carrier begins to flow from the source. The drain is an electrode from which the carrier exits the TFT. That is, the carriers in the MOSFET flow from the source to the drain. In the case of the n-type MOSFET NMOS, since the carrier is an electron, the source voltage has a voltage lower than the drain voltage so that electrons can flow from the source to the drain. In the n-type MOSFET, a current direction is from the drain to the source because electrons flow from the source to the drain. On the other hand, in the case of the p-type MOSFET PMOS, since the carrier is a hole, the source voltage has a voltage higher than the drain voltage so that holes can flow from the source to the drain. In the p-type MOSFET, a current direction is from the source to the drain because holes flow from the source to the drain. It should be noted that the source and drain of the MOSFET are not fixed. For example, the source and drain of the MOSFET may vary depending on the applied voltage. Therefore, in the description of the present disclosure, one of the source and the drain is referred to as a first electrode, and the other one of the source and the drain is referred to as a second electrode.

In this specification, the semiconductor layer of the TFT may be implemented by at least one of an oxide element, an amorphous silicon element, and a polysilicon element.

Figure 2:
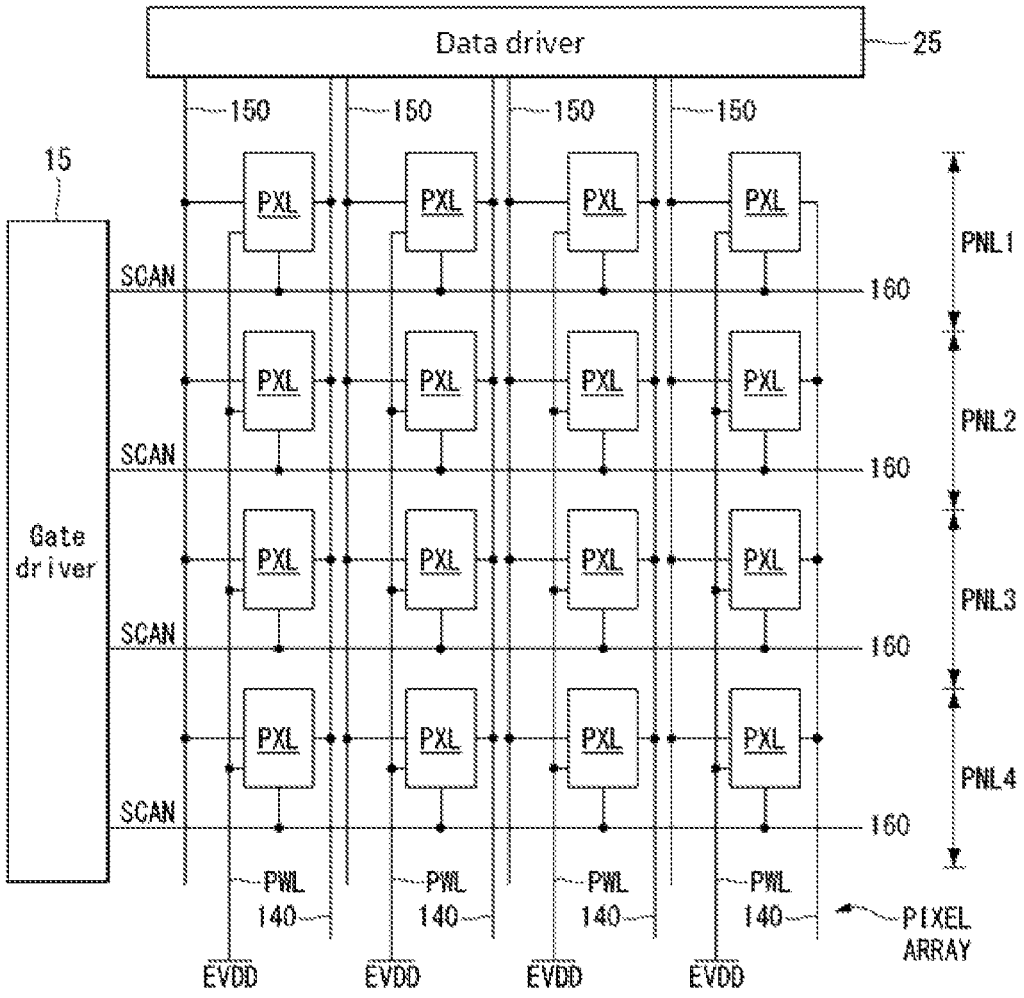
FIG. 2 shows a pixel array equipped in the display panel of FIG. 1.

FIG. 1 shows a block diagram illustrating an organic light emitting display device according to an embodiment of the present disclosure, and FIG. 2 shows a pixel array equipped in the display panel of FIG. 1.

Referring to FIGS. 1 and 2, the organic light emitting display device may comprise a display panel 10, a drive IC D-IC 20, a compensating IC 30, a host system 40 and a storage memory 50. The panel driving unit of the present disclosure may include a gate driving unit 15 equipped in the display panel 10 and a data driving unit 25 embedded in the driver IC D-IC 20.

The display panel 10 is equipped with a plurality of pixel lines PNL1~PNL4, and each pixel line is equipped with a plurality of pixels PXL and a plurality of signal lines. The pixel line in the present disclosure does not mean a physical signal line, but means a collection of the pixels PXL adjacent to each other along the direction in which a gate line extends and the signal lines. The signal lines may include the data lines 140 for supplying to the pixels PXL the data voltage VDIS for displaying and the data voltage VSEN for sensing, the reference voltage lines 150 for supplying a reference voltage VREF to the pixels PXL, the gate lines 160 for supplying gate signals to the pixels PXL and the high potential power lines PWL for supplying a high potential pixel voltage to the pixels PXL.

The pixels PXL in the display panel 10 are arranged in a matrix form to constituting a pixel array. Each pixel PXL included in the pixel array in FIG. 2 may be connected to one of the data lines 140, one of the reference voltage lines 150, one of the high potential power lines PWL and one of the gate lines 160. Each gate line 160 may be connected to a plurality of pixels PXL included in the pixel array. And, a low potential pixel voltage may be supplied to each pixel PXL included in the pixel array in FIG. 2 from a power generating unit. The power generating unit may supply the low potential pixel voltage to the pixels PXL through a low potential power line or a padding unit.

The gate driving unit 15 may be embedded in the display panel 10.

The gate driving unit 15 may include a plurality of stages connected to the gate lines 160 of the pixel array in FIG. 2. The stages may generate the gate signals for controlling the switch elements included in the pixels PXL and supply them to the gate lines 160.

The driver IC D-IC 20 may include a timing controller 21 and a data driving unit 25. The data driving unit 25 may include a sensing unit 22 and a driving voltage generator 23, but is not limited thereto.

The timing controller 21 may generate the gate timing control signals GDC for controlling the operating timings of the gate driving unit 15 and the data timing control signals DDC for controlling the operating timings of the data driving unit 25, based on the timing signals input from the host system 40, for example a vertical synchronization signal Vsync, a horizontal synchronization signal Hsync, a dot clock signal DCLK, a data enable signal DE, and so on.

The data timing control signals DDC may include a source start pulse, a source sampling clock, a source output enable signal, and so on, but are not limited thereto. The source start pulse controls a data sampling start timing of the driving voltage generator 23. The source sampling clock is a clock signal for controlling a data sampling timing based on a rising or falling edge. The source output enable signal controls an output timing of the driving voltage generator 23.

The gate timing control signals GDC may include a gate start pulse, a gate shift clock, and so on, but are not limited thereto. The gate start pulse is applied to the stage of generating a first scan signal to activate the stage. The gate shift clock is commonly supplied to the gate stages to shift the gate start pulse.

The timing controller 21 may sense the driving characteristics of the pixels PXL during at least one of a power on section, vertical active intervals in each frame, a vertical blank interval in each frame and a power off section by controlling the operating timing of the panel driving unit. Here, the power on section means the period until image is displayed immediately after system power is applied, and the power off section means the period until the system power is turned off immediately after the image display is terminated. The vertical active interval is the period during which image data is written to the display panel 10 for representing screen, and the vertical blank interval is located between adjacent vertical active intervals and means the period during which the writing of the image data is suspended. The driving characteristics include the threshold voltage and electron mobility of the driving elements included in the pixels PXL.

The timing controller 21 may implement display driving and sense driving by controlling sense driving timing and display driving timing for pixel lines PNL1~PNL4 in the display panel 10 according to a predetermined sequence.

The timing controller 21 may generate the timing control signals GDC and DDC for the display driving and the timing control signals GDC and DDC for the sense driving differently from each other. Sense driving means the operations which write the data voltage VSEN for sensing to the pixels PXL included in the pixel line to sense the driving characteristics of the corresponding pixels PXL, and update the compensating values for compensating for the change of the driving characteristics of the corresponding pixels PXL based on the data of the sensing results SDATA. Display driving means the operations which correct the digital image data to be input to the corresponding pixels PXL based on the updated compensating values, and apply to the corresponding pixels PXL the data voltage VDIS for displaying which corresponds to the corrected image data CDATA to display input image.

The driving voltage generator 23 is implemented by the digital to analog converter DAC for converting an analog signal into a digital signal. The driving voltage generator 23 generates the data voltage VSEN for sensing necessary for the sense driving and the data voltage VDIS for displaying necessary for the display driving and supplies them to the data lines 140. Also, the driving voltage generator 23 generates the reference voltage VREF further necessary for the sense driving and the display driving and supplies it to the reference voltage lines 150.

The data voltage VDIS for displaying may be a result of digital-to-analog conversion for the digital image data CDATA corrected in the compensating IC 30, and the magnitude of the data voltage VDIS for displaying may vary in pixel units according to a grayscale value and a compensating value. The data voltage VSEN for sensing may be set different in units of R(red), G(Green), B(blue) and W(white) pixels in considering that the driving characteristics of the driving elements are different for respective colors.

The sensing unit 22 may sense the driving characteristics of the pixels PXL, for example the threshold voltage and electron mobility of a driving element, the operating point voltage of a light emitting element, and the like, to the sensing lines. The sensing lines may be implemented by using the data lines 140 or the reference voltage lines 150. If the data lines 140 are utilized as the sensing lines, it is possible to unify a data output channel and a sensing channel, which is advantageous in reducing the number of pads of the driver IC D-IC 20. The sensing unit 22 may be implemented as a current sensing type of directly sensing the pixel current flowing through each pixel PXL. The sensing unit 22 may include a current integrator, and this will be described in detail with reference to FIG. 7.

The sensing unit 22 may simultaneously process a plurality of analog sensing values in parallel by using a plurality of ADCs, and may process the plurality of analog sensing values in a sequential manner using one ADC. The sampling rate and accuracy of the ADC are trade-offed to each other. The ADC of a parallel processing method have the advantage of increasing sensing accuracy because it can slow down a sampling rate compared to the DAC of a serial processing manner. The ADC may be implemented as the ADC of a flash type, the ADC using a tracking scheme, the ADC of a successive approximation register type, and so son. The ADC converts analog sensing values into digital sensing result data SDATA within a predetermined sensing range, and supplies the digital sensing result data SDATA to the storage memory 50 and the sensing output control unit 27.

The sensing unit 22 may include a sensing output regulator for regulating the sensing output voltage of the current integrator in order for the sensing output voltage (analog sensing value) not to deviate from the sensing range of the DAC, and this will be described in detail with reference to FIG. 7.

The driver IC D-IC 20 may further include a sensing output control unit 27. The sensing output control unit 27 may analyze the sensing result data SDATA input from the sensing unit 22, determine whether the positions where the plurality of sensing result data SDATA are distributed satisfy a specific section of the sensing range of the ADC, and control the operation of the sensing output regulator according to the determination result. This will be described in detail with reference to FIGS. 8 to 11B.

The storage memory 50 stores the digital sensing result data SDATA input from the sensing unit 22 in sense driving. The storage memory 50 may be implemented as a flash memory, but not limited thereto.

The compensating IC 30 may include a compensating unit 31 and a compensating memory 32. The compensating memory 32 transmits the digital sensing result data SDAT read from the storage memory 50 to the compensating unit 31. The compensating memory 32 may be a random access memory RAM, for instance a double date rate synchronous dynamic RAM, but not limited thereto. The compensating unit 31 calculates a compensating offset and a compensating gain for each pixel based on the digital sensing result data SDATA read from the storage memory 50, corrects the image data input from the host system 40 according to the compensating offset and gain, and supplies the corrected image data CDATA to the driver IC 20.

Figure 3:
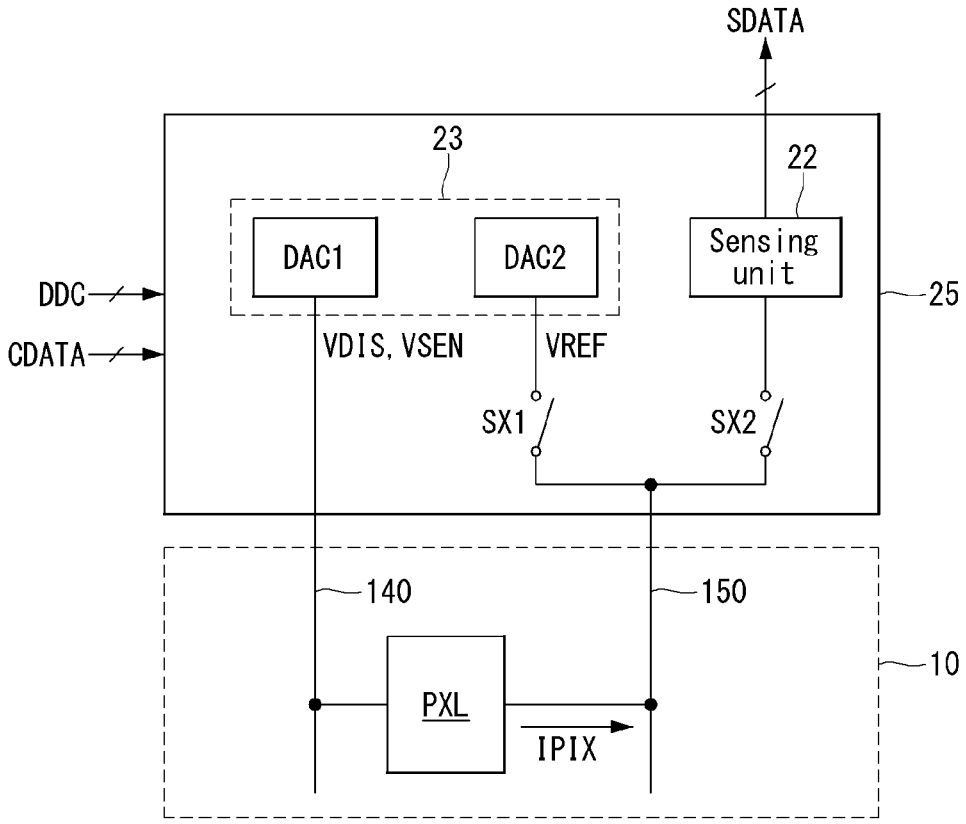
FIG. 3 shows the configuration of the data driving unit connected to the pixel array of FIG. 2.

FIG. 3 shows the configuration of the data driving unit connected to the pixel array of FIG. 2. The data driving unit 25 in FIG. 3 senses the driving characteristics of the pixels PXL through the reference voltage line 150.

Referring to FIG. 3, the data driving unit 25 may be connected to the first node of the pixel PXL (the gate electrode of a driving element) through the data line 140, and connected to the second node of the pixel PXL (the source electrode of the driving element) through the reference voltage line 150. Since a pixel current IPIX flows through the second node of the pixel PXL, the reference voltage line 150 connected to the second node via a second switching element may be used as a sensing line.

The reference voltage line 150 is selectively connected to the driving voltage generator 23 and the sensing unit 22 through connecting switches SX1 and SX2. The driving voltage generator 23 may comprise a first driving voltage generator DAC1 for generating the data voltage VSEN for sensing and the data voltage VDIS for displaying, and a second driving voltage generator DAC2 for generating the reference voltage VREF. The first connecting switch SX1 is connected between the reference voltage line 150 and the second driving voltage generator DAC2, and the second connecting switch SX2 is connected between the reference voltage line 150 and the sensing unit. The first and second connecting switches SX1 and SX2 are selectively turned on. Only the first connecting switch SX1 is turned on in synchronization with the timing at which the reference voltage VREF is applied to the pixel PXL, and only the second connecting switch SX2 is turned on in synchronization with the timing at which the pixel current flowing through the pixel PXL is sensed. So, the reference voltage line 150 is selectively connected to the second driving voltage generator DAC2 and the sensing unit 22 via the first and second connecting switches SX1 and SX2.

Figure 4:
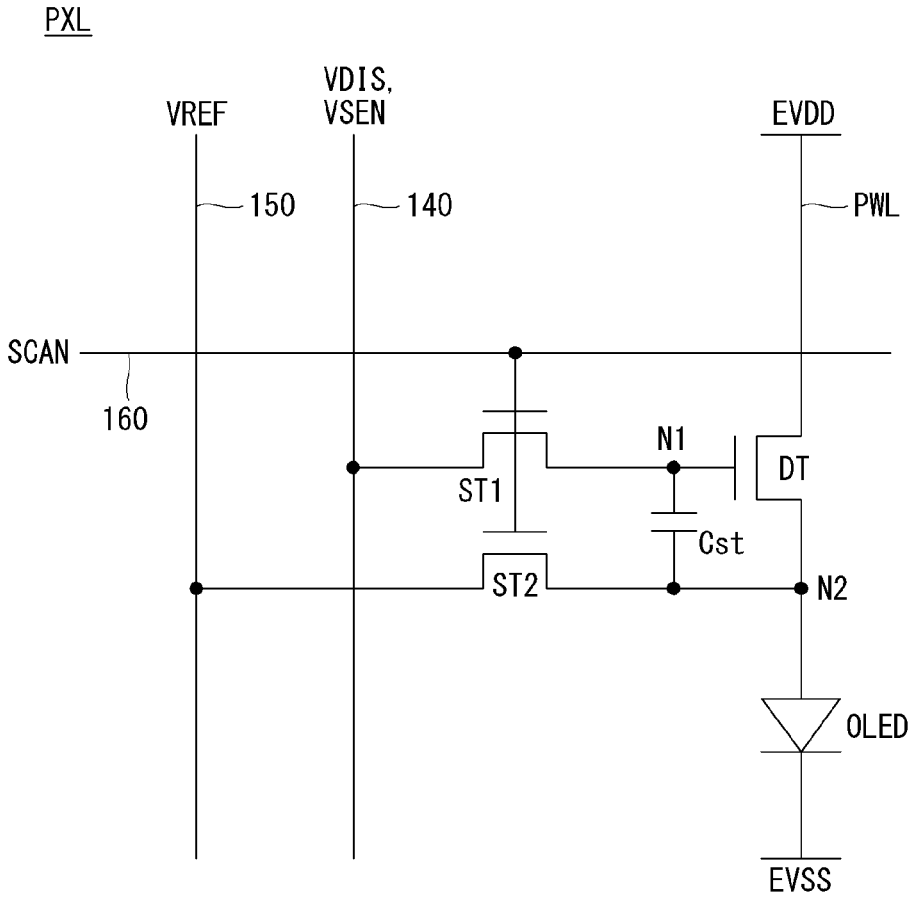
FIG. 4 shows an equivalent circuit of the pixel shown in FIG. 3.

FIG. 4 shows an equivalent circuit of the pixel shown in FIG. 3.

Referring to the FIG. 4, the pixel PXL utilizing the reference voltage line 150 as the sensing line comprises an OLED, a driving TFT DT, switching TFTs ST1 and ST2, and a storage capacitor Cst. The driving TFT DT and the switching TFTs ST1 and ST2 are implemented as NMOS, but not limited thereto.

The OLED is an element of emitting light with the intensity corresponding to the pixel current drawn from the driving TFT DT. An anode electrode of the OLED is connected to a second node N2 and a cathode node of the OLED is connected to an input terminal of a low potential voltage EVSS.

The driving TFT DT is a driving element for generates the pixel current according to the voltage difference between a gate electrode and a source electrode. The driving TFT DT comprises the gate electrode connected to a first node N1, the first electrode connected to an input terminal a high potential voltage EVDD through the high potential power line PWL, and a second electrode connected to a second node N2.

The switching TFTs ST1 and ST2 are the switching elements that establish the voltage between the gate and source electrodes of the driving TFT DT and connect the second electrode of the driving TFT DT and the reference voltage line 150. In some embodiments, the first electrode of the driving TFT DT is a drain electrode and the second electrode of the driving TFT DT is a source electrode.

The first switching TFT ST1 is connected between the data line 140 and the first node N1 and turned on according to a gate signal SCAN from the gate line 160. The first switching TFT ST1 is turned on in the program for the display driving or the sense driving. When the first switching TFT ST1 is turned on, the data voltage VSEN for sensing or the data voltage VDIS for displaying is applied to the first node N1. In the first switching TFT ST1, a gate electrode is connected to the gate line 160, a first electrode is connected to the data line 140 and a second electrode is connected to the first node N1.

The second switching TFT ST2 is connected between the reference voltage line 150 and the second node N2 and turned on according to the gate signal SCAN from the gate line 160. The second switching TFT ST2 is turned on in the program for the display driving or the sense driving to apply the reference voltage VREF to the second node N2. The second switching TFT ST2 is also turned on in a sensing period during the sense driving, and applies the pixel current generated from the driving TFT DT to the reference voltage line 150. In the second switching TFT ST2, a gate electrode is connected to the gate line 160, a first electrode is connected to the reference voltage line 150 and a second electrode is connected to the second node N2.

The storage capacitor Cst is connected between the first node N1 and the second node N2 to hold the voltage between the gate and source electrodes of the driving TFT DT for a period of time.

Figure 5:
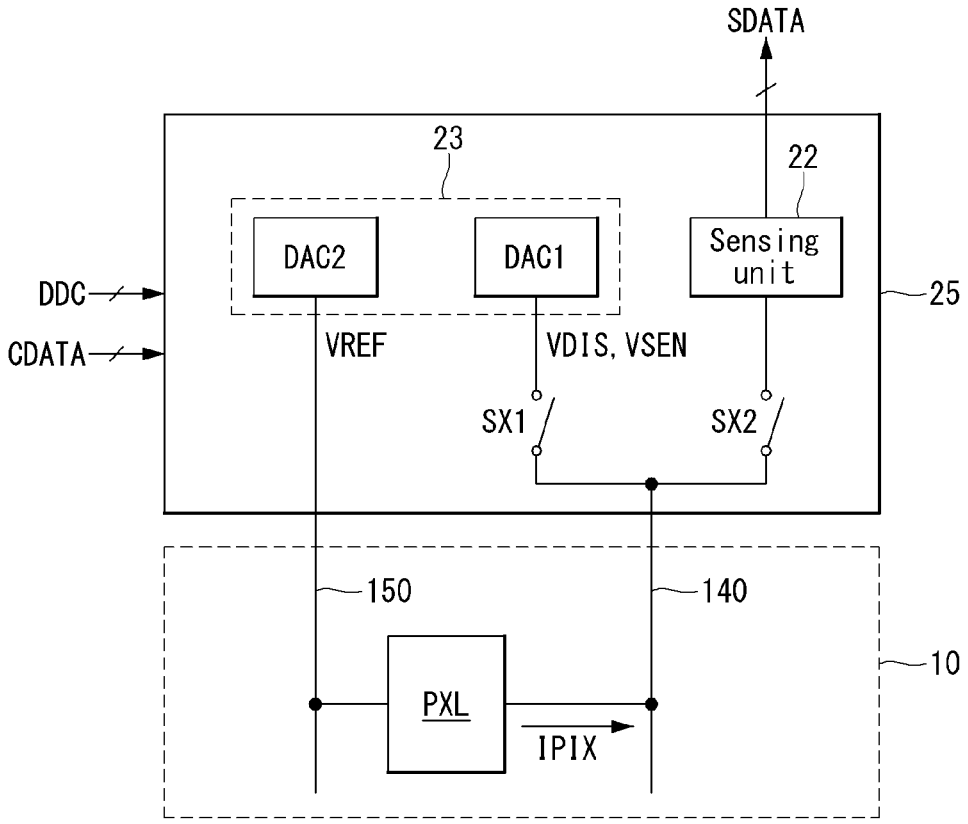
FIG. 5 shows another configuration of the data driving unit connected to the pixel array of FIG. 2.

Referring to FIG. 5, the data driving unit 25 may be connected to the first node of the pixel PXL (the gate electrode of a driving element) through the reference voltage line 150, and connected to the second node of the pixel PXL (the source electrode of the driving element) through the data line 140. Since a pixel current IPIX flows through the second node of the pixel PXL, the data line 140 connected to the second node via a second switching element may be used as a sensing line.

The data line 140 is selectively connected to the driving voltage generator 23 and the sensing unit 22 through connecting switches SX1 and SX2. The driving voltage generator 23 may comprise a first driving voltage generator DAC1 for generating the data voltage VSEN for sensing and the data voltage VDIS for displaying, and a second driving voltage generator DAC2 for generating the reference voltage VREF. The first connecting switch SX1 is connected between the data line 140 and the first driving voltage generator DAC1, and the second connecting switch SX2 is connected between the data line 140 and the sensing unit. The first and second connecting switches SX1 and SX2 are selectively turned on. Only the first connecting switch SX1 is turned on in synchronization with the timing at which the data voltage VSEN for sensing and the data voltage VDIS for displaying are applied to the pixel PXL, and only the second connecting switch SX2 is turned on in synchronization with the timing at which the pixel current flowing through the pixel PXL is sensed. So, the data line 140 is selectively connected to the first driving voltage generator DAC1 and the sensing unit 22 via the first and second connecting switches SX1 and SX2.

Figure 6:
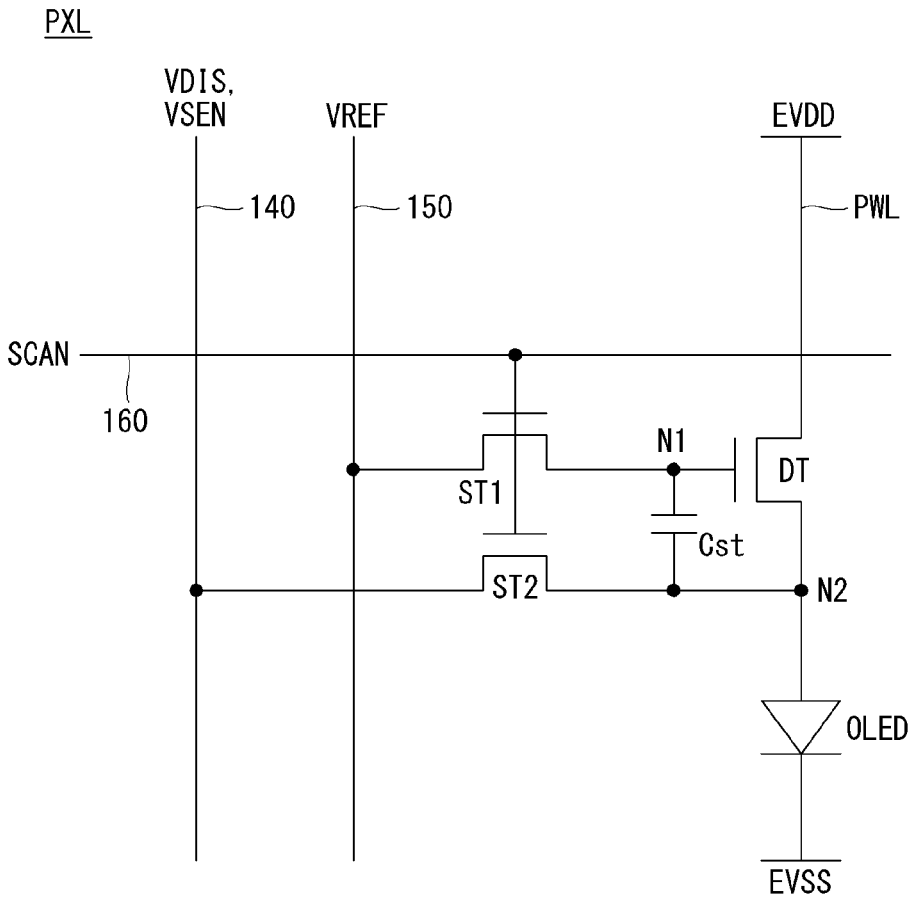
FIG. 6 shows an equivalent circuit of the pixel shown in FIG. 5.

FIG. 6 shows an equivalent circuit of the pixel shown in FIG. 5.

Referring to the FIG. 6, the pixel PXL utilizing the data line 140 as the sensing line comprises an OLED, a driving TFT DT, switching TFTs ST1 and ST2, and a storage capacitor Cst. The driving TFT DT and the switching TFTs ST1 and ST2 are implemented as NMOS, but not limited thereto.

The OLED is an element of emitting light with the intensity corresponding to the pixel current drawn from the driving TFT DT. An anode electrode of the OLED is connected to a second node N2 and a cathode node of the OLED is connected to an input terminal of the low potential voltage EVSS.

The driving TFT DT is a driving element for generates the pixel current according to the voltage difference between a gate electrode and a source electrode. The driving TFT DT comprises the gate electrode connected to a first node N1, a first electrode connected to an input terminal the high potential voltage EVDD through the high potential power line PWL, and a second electrode connected to a second node N2.

The switching TFTs ST1 and ST2 are the switching elements that establish the voltage between the gate and source electrodes of the driving TFT DT and connect the second electrode of the driving TFT DT and the data line 140.

The first switching TFT ST1 is connected between the reference voltage line 150 and the first node N1 and turned on according to the gate signal SCAN from the gate line 160. The first switching TFT ST1 is turned on in the program for the display driving or the sense driving. When the first switching TFT ST1 is turned on, the reference voltage VREF is applied to the first node N1. In the first switching TFT ST1, a gate electrode is connected to the gate line 160, a first electrode is connected to the reference voltage line 150 and a second electrode is connected to the first node N1.

The second switching TFT ST2 is connected between the data line 140 and the second node N2 and turned on according to the gate signal SCAN from the gate line 160. The second switching TFT ST2 is turned on in the program for the display driving or the sense driving to apply the data voltage VSEN for sensing or the data voltage VDIS for displaying to the second node N2. The second switching TFT ST2 is also turned on in a sensing period during the sense driving, and applies the pixel current generated from the driving TFT DT to the data line 140. In the second switching TFT ST2, a gate electrode is connected to the gate line 160, a first electrode is connected to the data line 140 and a second electrode is connected to the second node N2.

The storage capacitor Cst is connected between the first node N1 and the second node N2 to hold the voltage between the gate and source electrodes of the driving TFT DT for a period of time.

Figure 7:
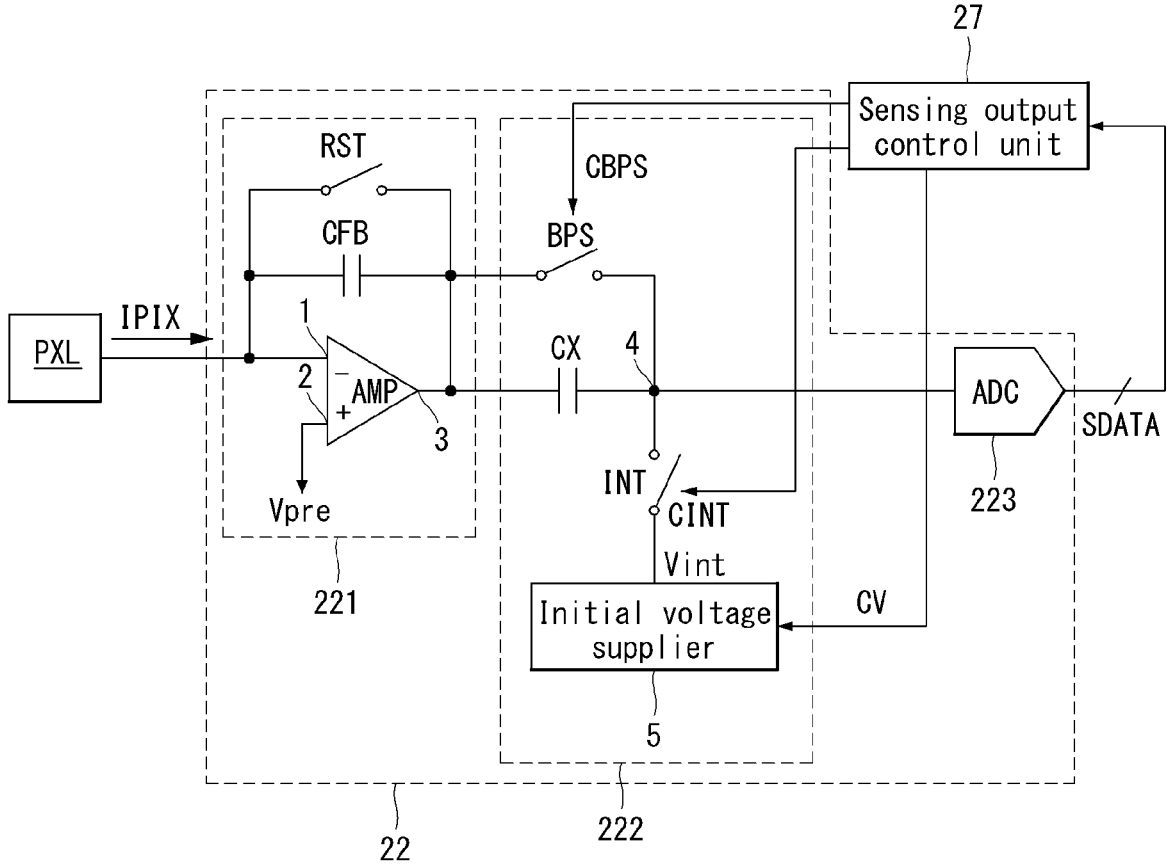
FIG. 7 shows the pixel sensing device according to the present disclosure.

FIG. 7 shows the pixel sensing device according to the present disclosure.

The pixel sensing device of FIG. 7 includes the sensing unit 22 shown in FIG. 1.

The sensing unit 22 may include a current integrator 221, a sensing output regulator 222 and an ADC 223. A sample and hold circuit may be equipped between the sensing output regulator 222 and the ADC 223, but description thereof will be omitted for convenience of explanation.

The current integrator 221 is connected to a pixel PXL through a sensing line of the display panel 10. The current integrator 221 integrates the pixel current IPIX flowing through the pixel PXL to generate a first sensing output voltage that varies from a reference voltage Vpre.

The current integrator 221 comprises an amplifier AMP, an integrating capacitor CFB and a reset switch RST. The amplifier AMP is equipped with an inverting input terminal (−) (corresponding to a first node (1)) to receive the pixel current IPIX from the sensing line, a non-inverting input terminal (+) (corresponding to a second node (2)) to receive the reference voltage Vpre, and an output terminal (corresponding to a third node (3)) to output the first sensing output voltage. The integrating capacitor CFB is connected between the inverting input terminal (−) and the output terminal of the amplifier AMP. The reset switch RST is further connected between t the inverting input terminal (−) and the output terminal of the amplifier AMP in parallel with the integrating capacitor CFB.

When the reset switch is turned on, the inverting input terminal (−), the non-inverting input terminal (+) and the output terminal of the amplifier AMP are reset to the reference voltage Vpre. When the pixel current IPIX is applied to the integrating capacitor CFB after the reset switch is turned off, the first sensing output voltage generated at the output terminal of the amplifier AMP is gradually lowered from the reference voltage Vpre. The falling slope of the first sensing output voltage is proportional to the magnitude of the pixel current IPIX for a period of time. So, in case that the pixel current IPIX is too small or too large, the first sensing output voltage may exceed the sensing limit of the ADC 223.

The ADC 223 converts an analog signal (that is the sensing output voltage) into a digital signal (that is digital sensing result data). When the sensing output voltage input to the ADC is out of the sensing range, the output value of the ADC may be underflowed below the lower limit value of the input voltage range or overflowed above the upper limit value of the input voltage range.

The sensing output regulator 222 regulates the output of the current integrator 221, that is the first sensing output voltage in order to prevent the output of the ADC 223 from being distorted. The sensing output regulator 222 regulates the first sensing output voltage to correspond to a specific section of the sensing range of the ADC 223 and inputs a second sensing output voltage obtained from the regulation to the ADC 223, thereby preventing the output of the ADC 223 from being underflowed or overflowed. Here, the specific section of the sensing range of the ADC 223 is a certain section centered on the center value of the sensing range. If the magnitude of the sensing output voltage is set near the center value of the sensing range, the output distortion of the ADC 223 is reduced.

The sensing output regulator 222 may be implemented by a coupling capacitor CX, an initial voltage supplier 5, and an initial voltage switch INT. The coupling capacitor CX is equipped with one electrode connected to the output terminal of the current integrator 221 and the other electrode connected to an input terminal (a fourth node (4)) of the ADC 223. The initial voltage supplier 5 supplies an initial voltage Vint different from the reference voltage Vpre. The initial voltage switch INT is connected between the initial voltage supplier 5 and the input terminal (4) of the ADC 223.

The initial voltage switch INT operates in synchronization with the reset switch RST. That is, the initial voltage switch INT and the reset switch RST is simultaneously turned on or off. When the initial voltage switch INT is turned on, the initial voltage Vint is applied to the input terminal (4) of the ADC 223.

When the first sensing output voltage of the output terminal (3) of the current integrator changes from the reference voltage Vpre in association with the on/off operation of the reset switch RST, the second sensing output voltage of the input terminal (4) of the ADC 223 changes from the initial voltage Vint to be different from the first sensing output voltage in association with the on/off operation of the initial voltage switch INT. The second sensing output voltage satisfies the specific section of the sensing range of the ADC 223.

When the first sensing output voltage is lowered from the reference voltage Vpre by a first value, the second sensing output voltage is lowered from the initial voltage Vint by the first value. That is, the voltage difference between the reference voltage Vpre and the first sensing output voltage is same as the voltage difference between the initial voltage Vint and the second sensing output voltage. This is resulted from the coupling effect of the coupling capacitor CX.

The change of the driving characteristics of a pixel is determined according to a change amount of a sensing output voltage with respect to a predetermined constant reference value which is known in advance. The present disclosure changes the predetermined constant reference value from the reference voltage Vpre to the initial voltage Vint by applying the initial voltage Vint to the input terminal (4) of the ADC 223, in case that the first sensing output voltage of the current integrator 221 deviates from the sensing range of the ADC 223. Even though the predetermined constant reference value is changed in consideration of the sensing range of the ADC 223, the driving characteristics of the pixel is still reflected to the second sensing output voltage. This is because the second sensing output voltage changes from the initial voltage Vint by the change amount of the first sensing output voltage.

The sensing output regulator 222 further includes a bypass switch BPS connected between the output terminal (3) of the current integrator 221 and the input terminal (4) of the ADC 223. The bypass switch BPS is turned on when the first sensing output voltage satisfies the sensing range of the ADC 223. At this time, the initial voltage switch INT is turned off, and the input terminal (4) of the ADC 223 is not supplied with the initial voltage Vint. That is, when the bypass switch BPS is turned on, the second sensing output voltage of the input terminal (4) of the ADC 223 becomes same as the first sensing output voltage of the output terminal (3) of the current integrator 221.

The pixel sensing device of FIG. 7 may further include a sensing output control unit 27 in addition to the sensing unit 22 of FIG. 1.

The sensing output control unit 27 generates a first control signal CINT for controlling the on/off operation of the initial voltage switch INT, a second control signal CV for controlling the level of the initial voltage Vint, and a third control signal CBPS for controlling the on/off operation of the bypass switch BPS, based on the analysis of a plurality of sensing result data SDATA input from the ADC 223.

The sensing output control unit 27 may derive a representative value of a plurality of sensing result data SDATA inputted from the ADC 223. Here, the representative value may be an average value or a most frequent value of the sensing result data SDATA.

When a distribution position of the representative value satisfies the specific section of the sensing range of the ADC 223, the sensing output control unit 27 may turn on the bypass switch BPS and turn off the initial voltage switch INT. On the other hand, when the distribution position of the representative value does not satisfy the specific section of the sensing range of the ADC 223, the sensing output control unit 27 may turn off the bypass switch BPS and turn on the initial voltage switch INT. The initial voltage switch INT is turned on only during a reset period of the current integrator 221 (the period when the reset switch RST is of an on state).

The sensing output control unit 27 may adjust the level of the initial voltage Vint by controlling the initial voltage supplier 5 in consideration of the sensing range of the ADCC 223.

Figure 8:
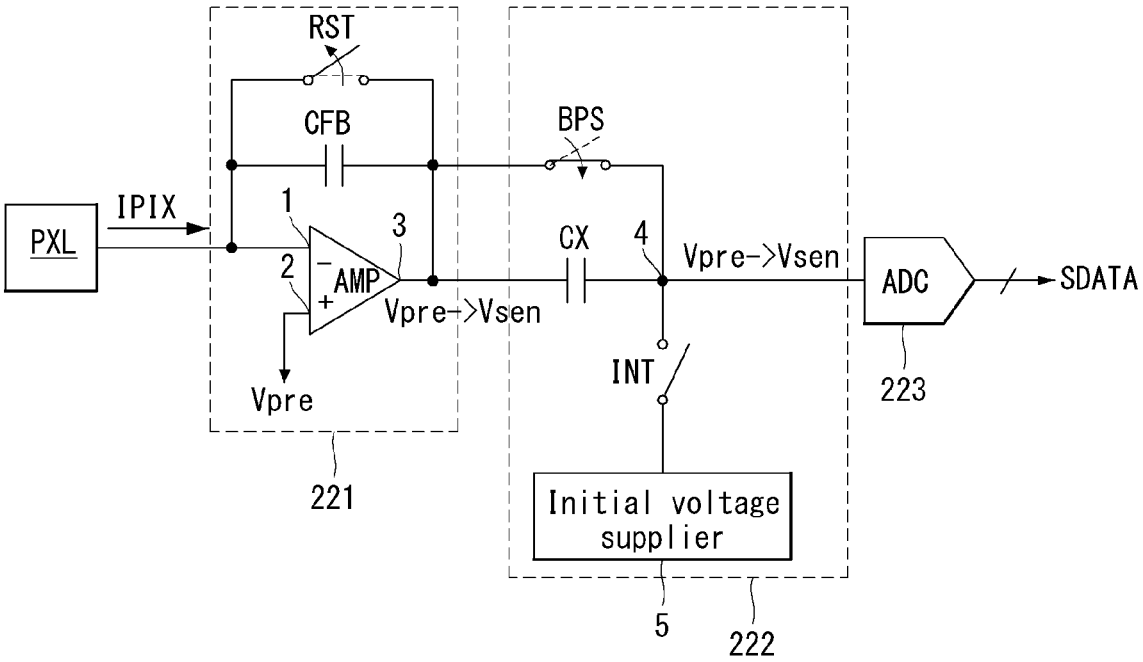
FIGS. 8 and 9 show the operation of the pixel sensing device when sensing result data satisfies the sensing range of the ADC.
Figure 9:
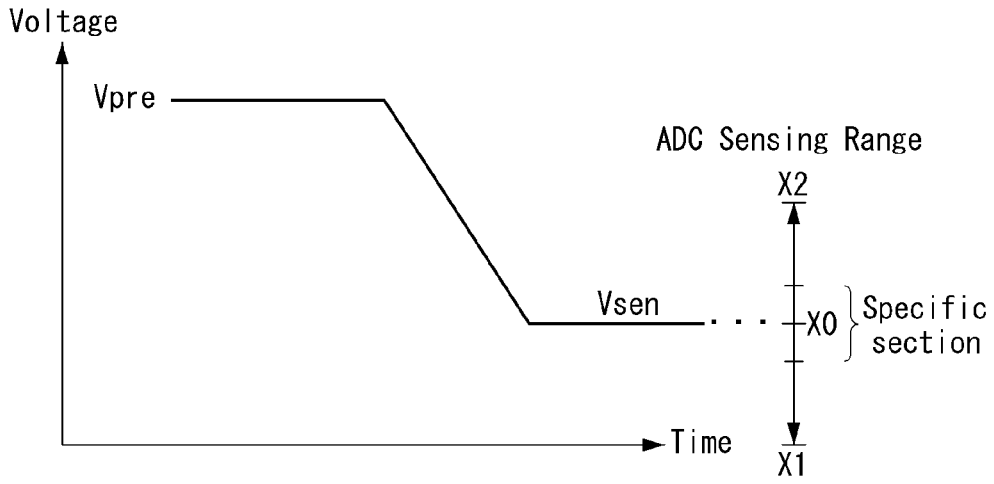

FIGS. 8 and 9 show the operation of the pixel sensing device when sensing result data satisfies the sensing range of the ADC. In FIG. 9, X0 is the center value of the sensing range X1~X2 of the ADC.

Referring to FIG. 8, when the distribution position of the representative value of the sensing result data SDATA satisfies the specific section of the sensing range of the ADC 223, the bypass switch BPS is turned on. The bypass switch BPS successively maintains its on state during the period of performing the sensing.

The first sensing output voltage loaded to the output terminal (3) of the current integrator 221 and the second sensing output voltage loaded to the input terminal (4) of the ADC 223 change from the reference voltage Vpre to a same voltage Vsen as shown in FIG. 9. Vsen satisfies the specific section of the sensing range of the ADC 223.

Figure 10:
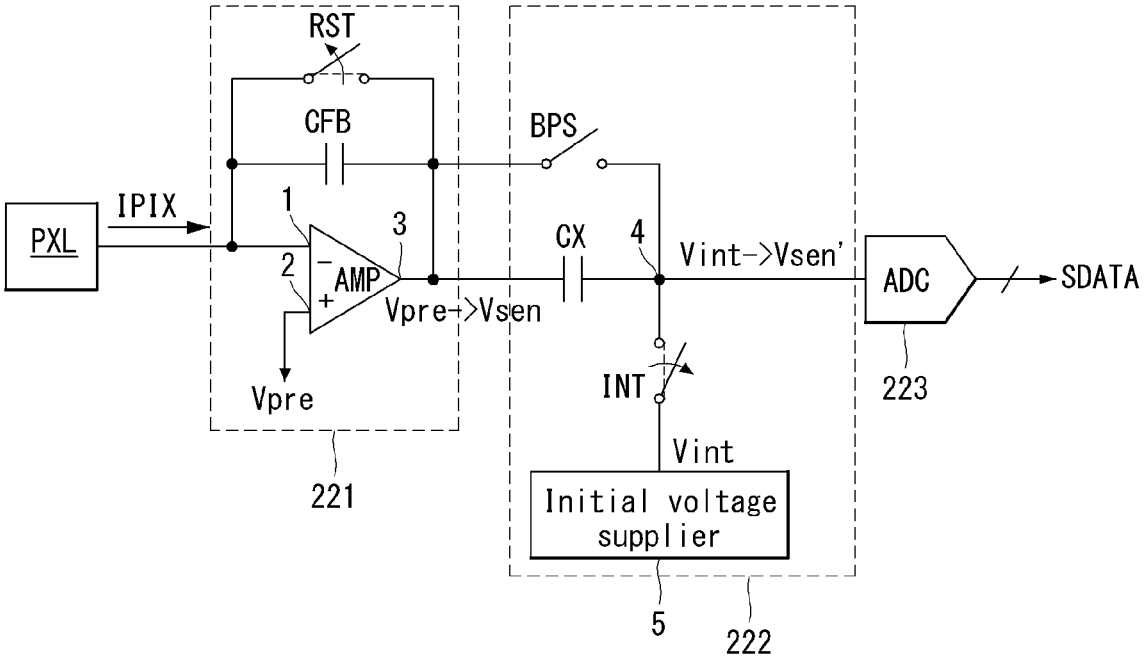
FIGS. 10, 11A and 11B show the operation of the pixel sensing device when sensing result data does not satisfy the sensing range of the ADC.
Figure 11A:
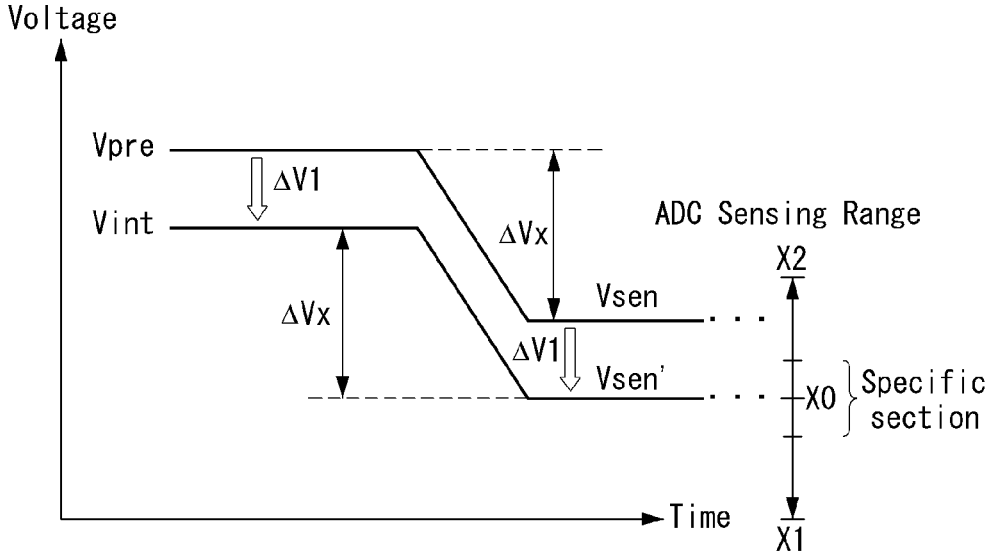
Figure 11B:
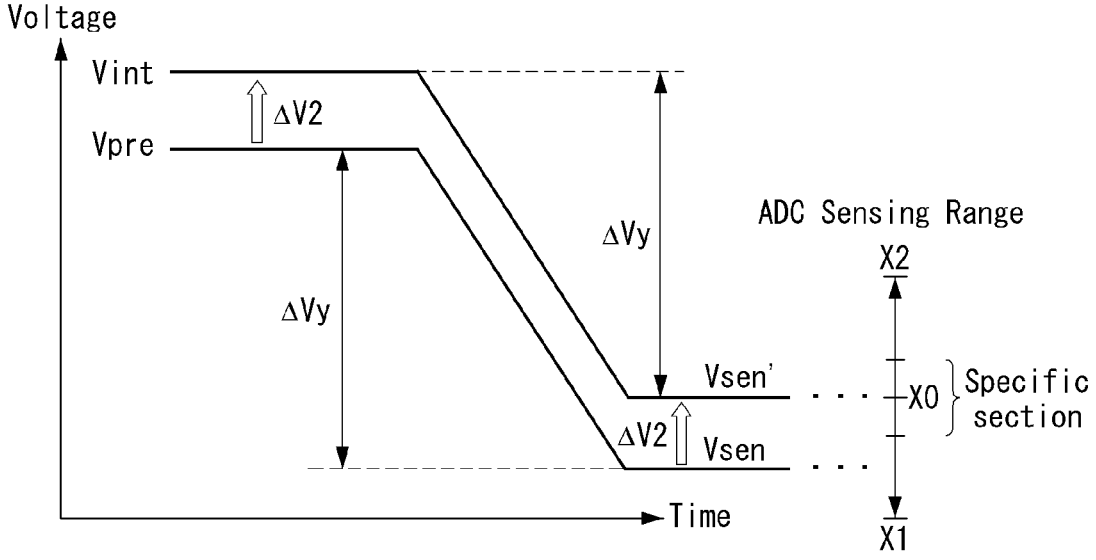

FIGS. 10, 11A and 11B show the operation of the pixel sensing device when sensing result data does not satisfy the sensing range of the ADC.

Referring to FIG. 10, when the distribution position of the representative value of the sensing result data SDATA does not satisfy the specific section of the sensing range of the ADC 223, the initial voltage switch INT is turned on in synchronization with the reset switch RST only during a reset period. At this time, the bypass switch BPS maintains its off state. As shown in FIGS. 11A and 11B, the reference voltage Vpre is loaded to the output terminal (3) of the current integrator 221 according to the on state of the reset switch RST during the reset switch, and the initial voltage Vint is loaded to the input terminal (4) of the ADC 223 according to the on state of the initial voltage switch INT.

Then, the reset switch RST and the initial voltage switch INT are turned off during a sensing period. During the sensing period, the bypass switch BPS maintains its off state. As shown in FIGS. 11A and 11B, as the charges according to the pixel current are accumulated in the integrating capacitor CFB during the sensing period, the first sensing output voltage Vsen changing from the reference voltage Vpre is loaded to the output terminal (3) of the current integrator 221. During the sensing period, the second sensing output voltage Vsen' changing from the initial voltage Vint is loaded to the input terminal (4) of the ADC 223 by the coupling effect of the coupling capacitor CX. At this time, the amount of change (ΔVx, ΔVy) of the first sensing output voltage Vsen versus the reference voltage Vpre and the amount of change (ΔVx, ΔVy) of the second sensing output voltage Vsen' versus the initial voltage Vint are same as each other.

Referring to FIG. 11A, if lowering the initial voltage Vint by ΔV1 than the reference voltage Vpre, the second sensing output voltage Vsen' is also lowered by ΔV1 than the first sensing output voltage Vsen. As can be known from this, by lowering the initial voltage Vint than the reference voltage Vpre in case that the first sensing output voltage Vsen is higher than the specific section of the sensing range, it is possible to apply the second sensing output voltage Vsen' corresponding to the specific section of the sensing range to the ADC 223.

Referring to FIG. 11B, if increasing the initial voltage Vint by ΔV2 than the reference voltage Vpre, the second sensing output voltage Vsen' is also increased by ΔV2 than the first sensing output voltage Vsen. As can be seen from this, by increasing the initial voltage Vint than the reference voltage Vpre in case that the first sensing output voltage Vsen is lower than the specific section of the sensing range, it is possible to apply the second sensing output voltage Vsen' corresponding to the specific section of the sensing range to the ADC 223.

As described above, the sensing output regulator capable of adjusting the sensing output voltage of the current integrator in order for the sensing output voltage not to deviate the sensing range of the ADC is equipped in the pixel sensing device of the present disclosure. The sensing output regulator comprises the coupling capacitor connected between the output terminal of the current integrator and the input terminal of the ADC, and an initial voltage supplying means for supplying to the input terminal of the ADC the initial voltage different from the reference voltage of the current integrator. In case that the first sensing output voltage deviates from the specific section of the sensing range of the ADC, the pixel sensing device may prevent the distortion of the sensing values due to underflow or overflow by decreasing or increasing the initial voltage than the reference voltage increasing thereby applying to the ADC the second sensing output voltage corresponding to the specific section of the sensing range.

At this time, due to the coupling effect of the coupling capacitor, the amount of change in the second sensing output voltage versus the initial voltage is same as the amount of change in the first sensing output voltage versus the reference voltage during the sensing period. Since the change of the driving characteristics of a pixel is determined according to an amount of change in the sensing output voltage with respect to a predetermined constant reference value which is known in advance, even though the voltage input to the ADC is changed from the first sensing output voltage to the second sensing output voltage in consideration of the sensing range of the ADC, the change in the driving characteristics of a pixel can be accurately determined.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. A display device comprising:

a display panel;

a driving circuit coupled to the display panel, the driving circuit for providing a preset sensing voltage to a pixel of a display panel;

a sensing circuit-coupled to the display panel, the sensing circuit for sensing a pixel current generated by the pixel, the sensing circuit comprising:

a current integrator generating an integrated voltage signal indicative of the pixel current, and an offset circuit for adding an offset to the integrated voltage signal, the offset based on a previously stored compensation amount for the pixel; and a compensation circuit coupled to the display panel, the compensation circuit determining a new compensation amount for the pixel based on the offset integrated voltage, and compensating a display voltage of the pixel by the new compensation amount in a subsequent display frame of the display device, wherein the offset is further based on a sensitivity range of an analog-to-digital converter connected to the offset circuit.

2. The display device of claim 1, wherein the offset circuit comprises:

a coupling capacitor having a first terminal coupled to an output of the sensing circuit;

an initial voltage supplier for supplying the offset; and an initialization switch, the initialization switch connecting the initial voltage supplier to a second terminal of the coupling capacitor for storing the offset in the coupling capacitor.

3. The display device of claim 2, wherein the current integrator comprises:

an amplifier having a first input terminal receiving a reference voltage, a second input terminal coupled to the pixel for receiving the pixel current, and an output terminal for outputting the integrated voltage signal;

a feedback capacitor coupled between the second input terminal of the amplifier and the output terminal of the amplifier; and a reset switch coupled between the second input terminal of the amplifier and the output terminal of the amplifier, wherein the reset switch is closed to initialize the output terminal of the amplifier to be the reference voltage.

4. The display device of claim 3, wherein the initialization switch operates in synchronization with the reset switch of the current integrator.

5. The display device of claim 4, wherein the integrated voltage signal of the current integrator changes from the reference voltage responsive to the reset switch turning off, and the offset integrated voltage changes from the offset responsive to the initialization switch turning off.

6. The display device of claim 5, wherein a voltage difference between the reference voltage and the integrated voltage signal is equal to a voltage difference between the offset and the offset integrated voltage.

7. The display device of claim 2, wherein the offset circuit further comprises:

a bypass switch coupled between the first and second terminal of the coupling capacitor, the bypass switch for bypassing the offset circuit when the bypass switch is closed.

8. The display device of claim 2, wherein the sensing circuit further comprises:

the analog-to-digital converter coupled to the second terminal of the coupling capacitor, the analog-to-digital converter having a sensitivity range, wherein the sensitivity range of the analog-to-digital converter is centered on a center value of a sensing range of the analog-to-digital converter.

9. A method comprising:

providing a preset sensing voltage to a pixel of a display device;

receiving a pixel current from the pixel, the pixel current based on the provided sensing voltage;

generating an integrated voltage signal indicative of a magnitude of the pixel current;

adding an offset to the integrated voltage signal, the offset based on a previously stored compensation amount for the pixel;

determining a new compensation amount for the pixel based on the offset integrated voltage; and compensating a display voltage of the pixel by the new compensation amount in a subsequent display frame of the display device, wherein the offset is further based on a sensitivity range of an analog-to-digital converter.

10. The method of claim 9, wherein generating the integrated voltage signal comprises:

resetting the integrated voltage signal to have a value of a reference voltage; and modifying the integrated voltage signal based on an integration of the pixel current.

11. The method of claim 10, wherein modifying the integrated voltage signal comprises:

decreasing a value of the integrated voltage signal with a rate according to the pixel current.

12. The method of claim 9, wherein adding an offset to the integrated voltage signal comprises:

determining the offset based on the previously stored compensation amount for the pixel; and storing the offset in a coupling capacitor configured to receive the integrated voltage signal.

13. The method of claim 9, wherein the adding an offset to the integrated voltage signal comprises:

increasing a voltage level of the integrated voltage signal responsive to a previous offset integrated voltage having a value below the sensitivity range of the analog-to-digital converter.

14. The method of claim 9, wherein the adding an offset to the integrated voltage signal comprises:

decreasing a voltage level of the integrated voltage signal responsive to a previous offset integrated voltage having a value above the sensitivity range of the analog-to-digital converter.

15. The method of claim 9, further comprising:

sampling the offset integrated voltage using an analog-to-digital converter; and wherein the new compensation amount is determined based on the sampled offset integrated voltage and the offset added to the integrated voltage signal.

16. A method comprising:

resetting a current integrator to have an output voltage substantially equal to a reference voltage;

integrating, by the current integrator, a pixel current received from a pixel of a display device;

generating an offset integrated voltage by adding an offset to the output voltage of the current integrator;

sampling the offset integrated voltage using an analog-to-digital converter;

determining a compensation amount for the pixel based on the sampled offset integrated voltage and the offset; and compensating a display voltage of the pixel by the compensation amount in a subsequent display frame of the display device, wherein the offset is further based on a sensitivity range of the analog-to-digital converter.

17. The method of claim 16, further comprising modifying the integrated voltage signal based on an integration of the pixel current, comprising:

decreasing the output voltage of the current integrator with a rate according to the pixel current.

18. The method of claim 16, wherein adding an offset to the output voltage of the current integrator comprises:

determining the offset based on a previous output of the analog-to-digital converter; and storing the offset in a coupling capacitor configured to receive the output voltage of the current integrator.

19. The method of claim 16, wherein the sensitivity range of the analog-to-digital converter is centered on a center value of a sensing range of the analog-to-digital converter.

* * * * *